US011359464B2

(12) United States Patent
Kogsboll et al.

(10) Patent No.: US 11,359,464 B2
(45) Date of Patent: Jun. 14, 2022

(54) METHODS AND APPARATUS FOR CREATING WELLBORES

(71) Applicant: Total E&P Danmark A/S, Copenhagen (DK)

(72) Inventors: Hans-Henrik Kogsboll, Gentofte (DK); Michael Dermot Mulrooney, Copenhagen (DK)

(73) Assignee: Total E&P Danmark A/S, Copenhagen (DK)

( * ) Notice: Subject to any disclaimer, the term of this patent is extended or adjusted under 35 U.S.C. 154(b) by 0 days.

(21) Appl. No.: 16/466,218

(22) PCT Filed: Nov. 1, 2017

(86) PCT No.: PCT/EP2017/077984
§ 371 (c)(1),
(2) Date: Jun. 3, 2019

(87) PCT Pub. No.: WO2018/103970
PCT Pub. Date: Jun. 14, 2018

(65) Prior Publication Data

US 2020/0063535 A1 Feb. 27, 2020

(30) Foreign Application Priority Data

Dec. 6, 2016 (GB) ..... 1620741

(51) Int. Cl.
*E21B 43/10* (2006.01)
*E21B 7/04* (2006.01)
(Continued)

(52) U.S. Cl.
CPC ..... *E21B 43/10* (2013.01); *E21B 7/046* (2013.01); *E21B 33/12* (2013.01); *E21B 34/06* (2013.01); *E21B 43/26* (2013.01)

(58) Field of Classification Search
CPC ..... E21B 43/10; E21B 43/26; E21B 7/046; E21B 33/12; E21B 34/06
(Continued)

(56) References Cited

U.S. PATENT DOCUMENTS

2008/0041588 A1 2/2008 Richards
2009/0294122 A1* 12/2009 Hansen ..... E21B 43/25 166/250.01
(Continued)

FOREIGN PATENT DOCUMENTS

CN 201165866 Y * 12/2008
EP 1184537 3/2002
(Continued)

OTHER PUBLICATIONS

International Preliminary Report on Patentability and Written Opinion for International Application No. PCT/EP2017/077984 dated Jun. 20, 2019.
(Continued)

*Primary Examiner* — Matthew R Buck
*Assistant Examiner* — Patrick F Lambe
(74) *Attorney, Agent, or Firm* — Carlson, Gaskey & Olds, P.C.

(57) ABSTRACT

A method of creating a horizontal wellbore section comprises drilling the section in at least two stages. The method comprises drilling a first horizontal bore section. The first horizontal bore section is then provided with a first liner having a wall including initially-closed flow ports. The first liner isolates the wall of the first bore section. A second horizontal bore section is then drilled beyond the first horizontal bore section. The second horizontal bore section is provided with a second liner. Stimulation fluid is then directed into the first and second liners so that the stimulation fluid passes through the wall of the second liner to
(Continued)

stimulate the second horizontal bore section. The flow ports in the wall of the first liner are then opened so that the stimulation fluid passes through the wall of the first liner to stimulate the first horizontal bore section.

38 Claims, 5 Drawing Sheets

(51) Int. Cl.
*E21B 33/12* (2006.01)
*E21B 34/06* (2006.01)
*E21B 43/26* (2006.01)

(58) Field of Classification Search
USPC ..... 166/307
See application file for complete search history.

(56) References Cited

U.S. PATENT DOCUMENTS

| | | | |
|---|---|---|---|
| 2010/0230103 | A1 | 9/2010 | Parker |
| 2011/0220362 | A1 | 9/2011 | Huang et al. |

FOREIGN PATENT DOCUMENTS

| | | |
|---|---|---|
| WO | 2012011994 | 1/2012 |
| WO | 2012087431 | 6/2012 |

OTHER PUBLICATIONS

International Search Report and Written Decision for application No. PCT/EP2017/077984 dated Jan. 30, 2018.

* cited by examiner

METHODS AND APPARATUS FOR CREATING WELLBORES

The application is a National Phase Application of International Application No. PCT/EP2017/077984 filed on Nov. 1, 2017, which claims priority to United Kingdom Application No. 1620741.7 which was filed on Dec. 6, 2016.

FIELD OF THE DISCLOSURE

This disclosure describes methods and apparatus for creating wellbores. The disclosure has particular relevance for the creation of longer horizontal wellbore sections.

BACKGROUND OF THE DISCLOSURE

In the oil and gas exploration and production industry it is now common practice for wells to include substantially horizontal sections which extend along hydrocarbon-bearing formations. Operators face a number of technical challenges when drilling and completing such horizontal sections.

SUMMARY OF THE DISCLOSURE

According to an aspect of the disclosure there is provided a method of creating a horizontal wellbore section, the method comprising:

- drilling a first horizontal bore section with a bore wall having a first bore diameter;
- lining the first horizontal bore section with a first liner having a wall;
- isolating the wall of the first bore section with the first liner by isolating a first annulus between the wall of the first horizontal bore section and the first liner;
- subsequently drilling a second horizontal bore section beyond the first horizontal bore section which includes the first liner therein, the second horizontal bore section having a bore wall with a second bore diameter;
- lining the second horizontal bore section with a second liner;
- directing stimulation fluid into the first and second liners so that the stimulation fluid passes through the wall of the second liner to stimulate the second horizontal bore section; and
- opening flow ports in the wall of the first liner so that the stimulation fluid passes through the wall of the first liner and through the first annulus to stimulate the first horizontal bore section.

The steps of the method may be carried out in the order as recited above, or in other aspects the order of the steps may differ.

Embodiments of the disclosure may be particularly useful in the creation of relatively long horizontal well bore sections extending through hydrocarbon-bearing formations. For example, each of the first and second well bore sections may be in the region of 10,000 feet long, such that the first and second sections combine to provide a composite horizontal well bore section in the region of 20,000 feet long.

Aspects of the disclosure relate to well apparatus used in the method and to a well formed using the method.

When drilling a bore section, drilling fluid is pumped from surface down through the drill string and exits the string through jetting nozzles in the drill bit. The drilling fluid then flows back to surface via the annulus between the drill string and the wall of the drilled bore. Upper sections of the annulus will be contained within metal casing but the lowermost or distal section of the annulus will extend through unlined bore. The drilling fluid experiences pressure losses as it circulates and the initial drilling fluid pumping pressure must be sufficient to overcome all of these losses. Some of these pressure losses will occur as the drilling fluid flows through the annulus between the drill string and the wall of the bore such that there will be a pressure differential in the annulus, in addition to the hydrostatic pressure differential. In a longer horizontal section the pressure differential may be significant and may become a limiting factor in the length of section which can be drilled; the pressure of the drilling fluid exiting the drill bit required to maintain adequate flow through the annulus may result in damage to the surrounding formation, for example pushing the drilling fluid, and the particles suspended in the fluid, into the surrounding lower-pressure formation. This may be a particular issue where the formation, or a section of the formation, is depleted and exhibits a relatively low pore pressure.

An elevated pressure differential between the drilling fluid in the wellbore and the formation may also increase the likelihood of differential sticking; a portion of the drill string lying in contact with the unlined bore wall is urged against the bore wall by the higher pressure fluid in the wellbore. This is a particular issue in horizontal wellbores, where portions of the drill string may tend to contact the bore wall on the low side of the bore; if rotation of the drill string stops, these portions of the drill string may stick to bore wall and the resulting increase in friction may be prevent the drill string from moving.

Conventionally, if it is desired to drill a longer horizontal section, the horizontal section will be drilled in stages, with the most-recently drilled section being lined and cemented before drilling the next stage. However, cementing a bore section is a time-consuming, complex and expensive operation and further time-consuming, complex and expensive subsequent operations are required in order to produce from a formation that has been lined and cemented. For example: once a liner is cemented, additional time and cost is incurred in perforating the liner in order to access the formation surrounding the cemented region; once the liner has been perforated it is necessary to install an inner string of tubing inside the liner, and the inner string will typically comprise isolation packers to segment the perforated interval into manageable lengths for stimulation, and sliding sleeves to access these isolated perforated intervals; once the inner string is installed, stimulation time and cost is required due to the requirement to open and close each sliding sleeve and stimulate each interval length separately; opening and closing of sliding sleeves is typically executed via mechanical means (coiled tubing, wireline tractor, or via expensive surface controlled means, known as a smart completion); and after stimulation of all of the intervals associated with a particular liner one, all of the sliding sleeves must then be opened via the same means outlined above.

In embodiments of the present disclosure the isolation of the wall of the first bore section by the provision of the first liner is achieved without cementing and thus facilitates drilling of longer horizontal wells with significant savings in time and cost over conventional operations in which bore sections must be cemented before drilling subsequent bore sections.

One or both of the first horizontal bore section and the second horizontal bore section may be drilled until a predetermined differential pressure over the length of the bore section is reached. The differential pressure may depend on a number of factors and will typically be in the region of 800 psi.

The subsequent stimulation of the horizontal bore sections is facilitated by the ability to open or create flow ports in the wall of the first liner. The opening of the flow ports may be achieved by any appropriate means, for example by perforating the first liner or by providing flow ports in the first liner that are initially closed. The flow ports may be initially closed and then opened by any appropriate mechanism or means, for example the flow ports may be initially closed with plugs that are soluble or otherwise degradable in the stimulation fluid. The stimulation fluid may comprise an acid, for example hydrochloric acid. This allows the ports to be safely opened after the drilling operation has been completed and without requiring separate operator intervention.

Subsequently, fluid may flow from the formation and into the well through the flow ports.

The first annulus may be filled with bore fluid, for example drilling fluid that has been circulated during the drilling operation, or fluid that has been circulated as the first liner is being run into the bore. The first annulus may be filled with cleaning fluid that has been circulated before the wall of the first section has been isolated.

The wall of the first horizontal bore section, and the first annulus, may be isolated by activation or actuation of barriers, packers or isolation members provided on the first liner, which barriers may extend between the liner and the bore wall. The barriers may take any appropriate form, and may be formed of any appropriate material. The barriers provided towards the proximal end of the first liner may comprise hangers or the like for securing and sealing the proximal end of the first liner to an existing bore lining tubular, for example the distal end of an existing section of casing or liner. The barriers provided towards the distal end of the first liner may be configured for sealing the distal end of the first liner to the wall of a distal portion of the first horizontal bore section. Similar barriers may be provided for sealing the proximal end of the first liner to the wall of a proximal portion of the first horizontal bore section.

The barriers may be activated in any appropriate way, for example by inflation, or the barriers may be mechanically extended. The barriers may be of metal or may include elastomers. In some cases the barriers may incorporate swellable materials, for example a material that swells in response to the ambient well fluid such that the packers become effective without requiring operator intervention.

The second horizontal bore section may be drilled out of a distal end of the first liner, and may be drilled out of a distal end of the first horizontal bore section.

The first liner may have a first liner diameter and the second bore diameter may be smaller than the first liner diameter. However, the second horizontal bore section may be drilled or otherwise opened to a larger diameter if desired, for example using a bi-centre or expandable bit or by under-reaming.

One or both of the first and second liners may be fixed diameter liners.

The flow ports may take any appropriate form, for example the number, dimensions, form and distribution of the flow ports in the wall of the first liner being selected by the operator in accordance with the requirements of the stimulation operation.

The second liner may comprise flow ports. The flow ports may be initially open.

One or both of the first liner and the second liner may be a controlled acid jetting (CAJ) liner. One or both of the first and second liner may feature a pre-drilled hole pattern facilitating diversion of stimulation fluid evenly along the respective horizontal bore section.

The method of the disclosure may comprise the formation of three or more bore sections, typically with all but the final bore section being lined with liners provided with initially closed flow ports.

According to a further aspect of the disclosure there is provided wellbore-lining apparatus for lining a horizontal wellbore section comprising first and second bore sections, the apparatus comprising:

- a first wellbore liner having a wall and an isolation barrier towards a distal end of the wall, whereby the first wellbore liner may extend through the first bore section and the isolation barrier is configurable to engage a wall of the first bore section to isolate the first bore section; and
- a second wellbore liner for lining the second bore section beyond the first bore section.

The first and second wellbore liners may be configured to be installed in the wellbore separately. For example, the first wellbore liner may be installed in the first bore section, and the second bore section may then be drilled beyond the first bore section with the first wellbore liner installed therein. The second wellbore liner may then be subsequently installed through the first lined bore section and into the second bore section.

The wellbore-lining apparatus may be used in the method according to any other aspect, and as such features defined in relation to the method of any other aspect may be considered to also be disclosed in combination with the wellbore-lining apparatus.

According to another aspect of the disclosure there is provided wellbore-lining apparatus for lining a horizontal wellbore section comprising first and second bore sections, the apparatus comprising:

- a first wellbore liner having a wall including initially-closed flow ports for isolating the wall of the first bore section, the flow ports being closed by plugs dissolvable by stimulation fluid; and
- a second wellbore liner for lining the second bore section beyond the first bore section,
- whereby, in use, stimulation fluid directed into the first and second wellbore liners passes through the second wellbore liner to stimulate the second horizontal bore section and the stimulation fluid dissolves the plugs in the first wellbore liner to open the flow ports in the wall of the first wellbore liner so that the stimulation fluid passes through the wall of the first wellbore liner to stimulate the first horizontal bore section.

These aspects may be provided in combination with some or all of the features described above with reference to the first-described aspect. The various aspects may also be provided in combination with some or all of the features recited in the appended claims, and in combination with some or all of the features of the exemplary method and apparatus described below.

The present disclosure makes reference to horizontal well sections. Those of skill in the art will understand that this encompasses well sections which may be inclined from the horizontal or may vary in inclination. Aspects of the present disclosure may also have utility in non-horizontal and vertical well bore sections.

BRIEF DESCRIPTION OF THE DRAWINGS

These and other aspects of the present disclosure will now be described, by way of example only, with reference to the accompanying drawings, in which.

DETAILED DESCRIPTION OF THE DRAWINGS

Figure 1:
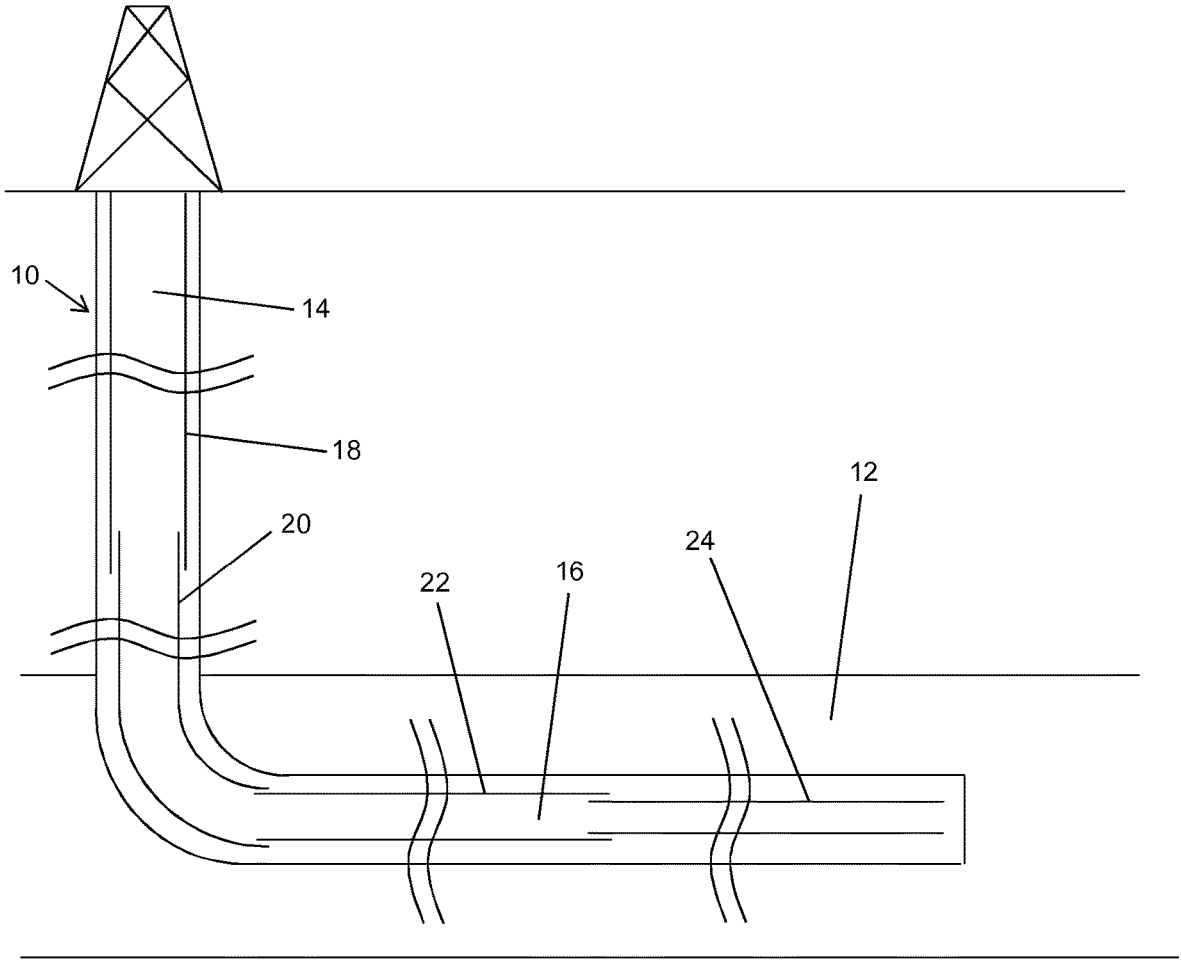
FIG. 1 is a schematic representation of a wellbore.

Reference is first made to FIG. 1 of the drawings, which is a schematic representation of a wellbore 10, in accordance with an embodiment of the disclosure, the wellbore 10 providing access to a hydrocarbon-bearing formation 12. The wellbore includes a substantially vertical section 14 and a substantially horizontal section 16 which extends through the formation 12. The vertical section 14 and the initial part of the horizontal section 16 are lined with metal casing and liner 18, 20. The remainder of the horizontal section 16 features two lengths of controlled acid jetting (CAJ) liner 22, 24, as will be described below.

It will be noted that the description below includes references to, for example, wellbore sections of particular lengths and diameters and liners of particular diameters. The skilled person will appreciate that these dimensions are provided merely by way of example and that the disclosure has utility in wellbores of any appropriate dimensions and may utilise liners and other apparatus of any appropriate dimensions.

Figure 2:
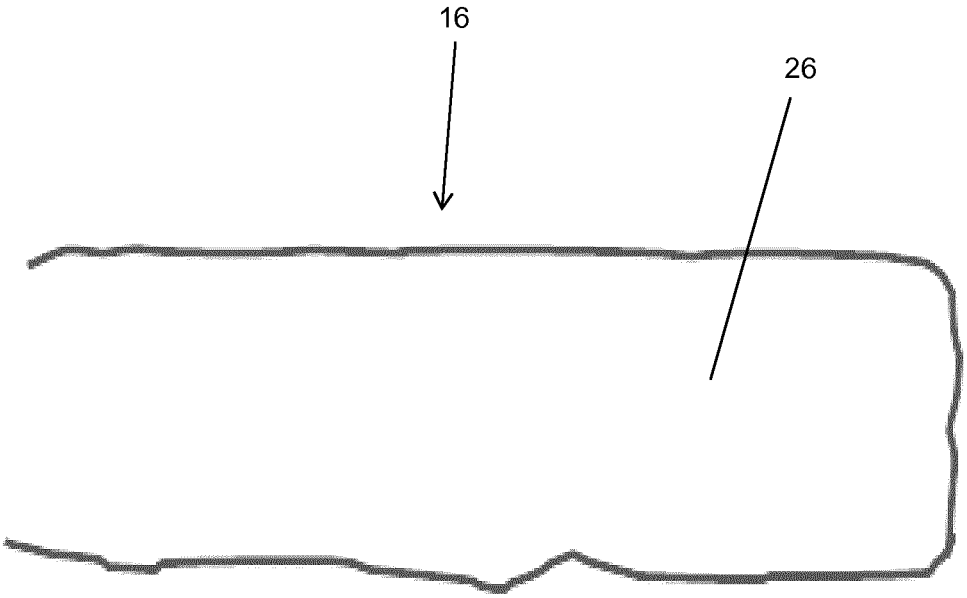
FIGS. 2 to 7 illustrate stages in the creation of a horizontal wellbore section.

The creation of the horizontal section 16 will now be described with reference to FIGS. 2 to 7. The horizontal section 16 is drilled in two stages. Initially an 8½ inch diameter 10,000 feet first horizontal bore section 26 is drilled as illustrated in FIG. 2. During the drilling operation, the differential pressure between the distal and proximal ends of the annulus between the drill string and the wall of the bore section 26 may be up to, for example, 800 psi.

Figure 3:
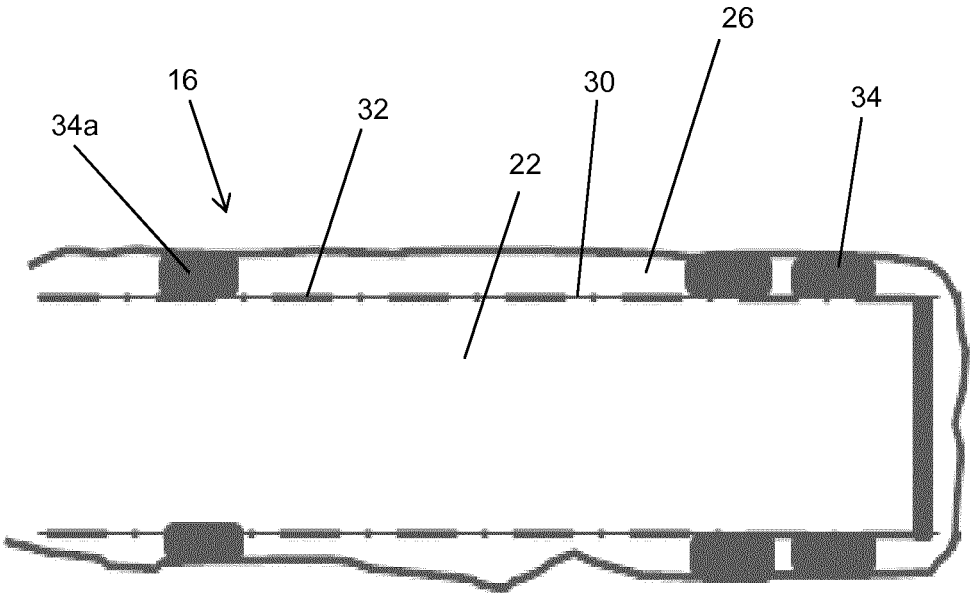

As illustrated in FIG. 3, a 7 inch diameter liner 22 is installed in the section 26. The liner 22 has a wall 30 provided with acid-soluble plugs 32 and external annular barriers 34 are provided towards the ends of the liner 22 (two barriers 34 towards the distal end of the liner 22 and one barrier 34 towards the proximal end of the liner 22). The barriers 34 may take any appropriate number and form and may be, for example, mechanically expandable metal barriers; the liner 22 is run into the section 26 with the barriers 34 in a retracted configuration. The expanded barriers 34 engage with the wall of the bore section 26 (or a proximal barrier 34*a* may engage a wall of an existing casing or liner). The installed liner 22 thus isolates the wall of the first bore section 26, and in particular protects the formation surrounding the bore section 26 from high pressure fluid in the bore section 26.

Figure 4:
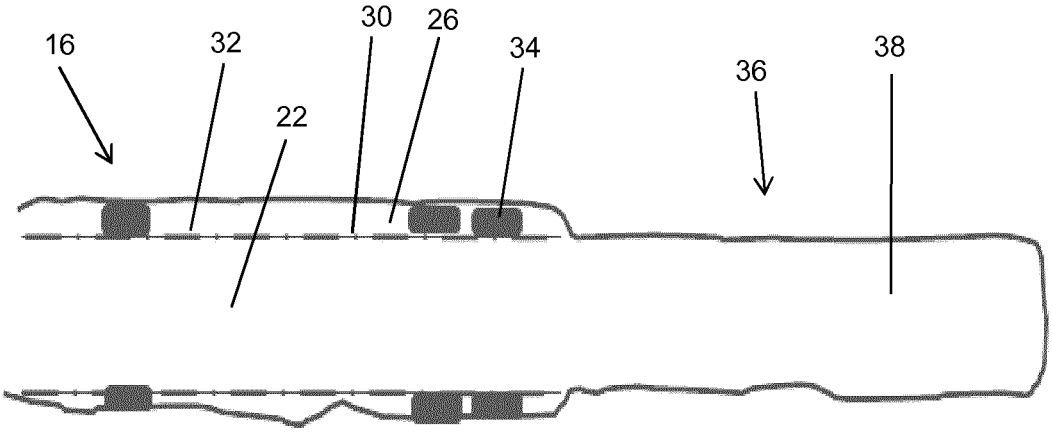

As illustrated in FIG. 4, a 6 inch diameter 10,000 feet long bore 36 is then drilled out of the distal end of the 7 inch liner 22 to create a second horizontal bore section 38 beyond the first horizontal bore section 26. During the drilling operation the differential pressure between the distal and proximal ends of the annulus between the drill string and the wall of the bore 36 may be up to, for example, 800 psi.

Figure 5:
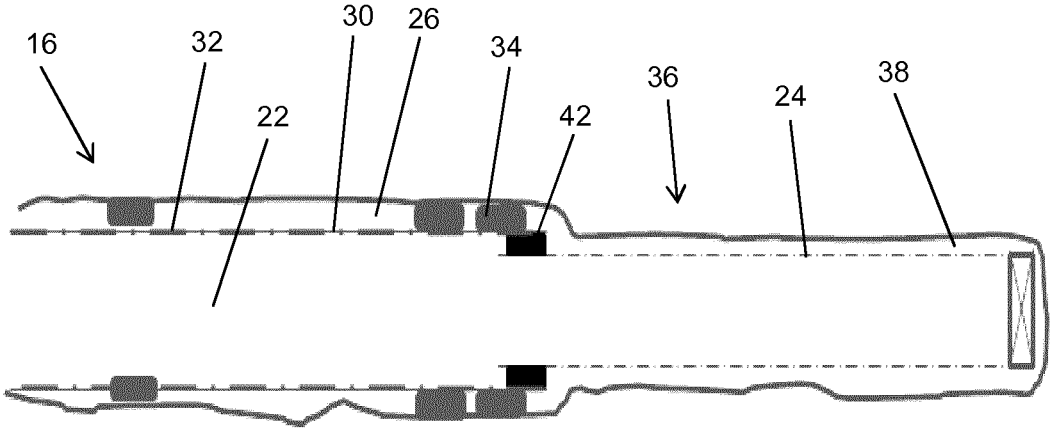

A 4½ inch diameter controlled acid jetting (CAJ) liner 24 is then installed in the bore section 38, as illustrated in FIG. 5. The proximal end of the CAJ liner 24 is sealed and secured to the distal end of the 7 inch liner 22 using a liner hanger 42. The CAJ liner 24 has a pervious wall; typically, a CAJ liner will have a limited number of unevenly spaced pre-drilled holes in the wall of the liner, the hole pattern being chosen to facilitate diversion of stimulation fluid evenly along the respective horizontal bore section, as described below.

Figure 6:
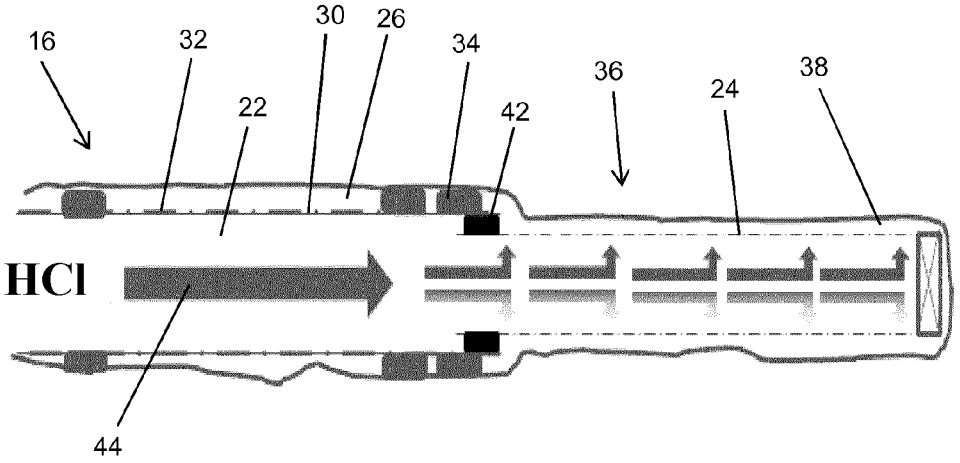

Stimulation fluid 44 is then pumped into the horizontal section 16, as illustrated in FIG. 6. In the illustrated embodiment the stimulation fluid 44 comprises hydrochloric acid (HCl). The holes in the wall of the CAJ liner 24 permit the stimulation fluid to contact the wall of the second bore section 38.

Figure 7:
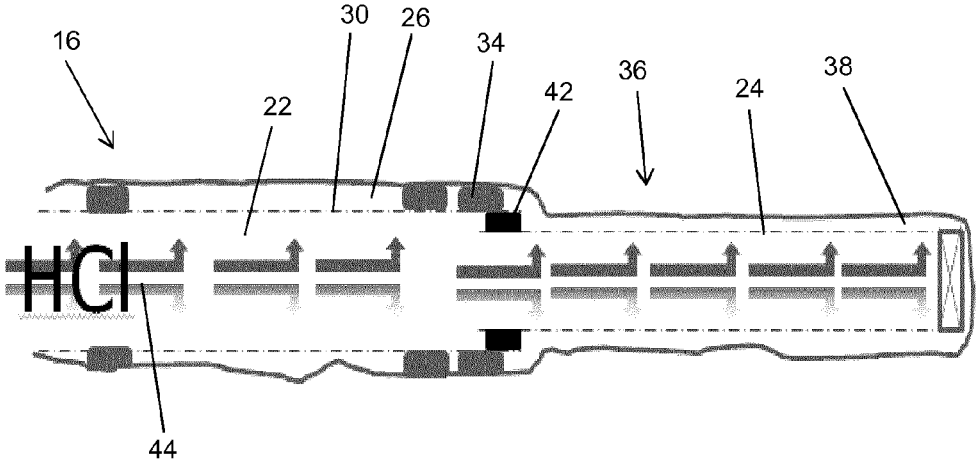

After a time, the acid-soluble plugs in the 7 inch liner 22 are dissolved by the stimulation fluid 44, permitting the fluid 44 to contact the wall of the first section 26, as illustrated in FIG. 7.

Figure 8:
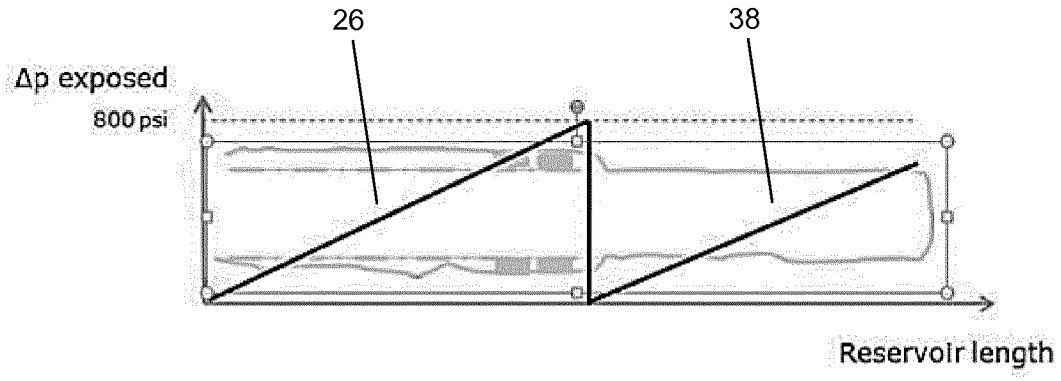
FIG. 8 illustrates the pressure differential along the length of the horizontal sections during the drilling of the respective sections.

The horizontal section 16 has thus been drilled, lined and stimulated without cementing. In particular, the first liner 22 isolates the wall of the first bore section 26 and protects the formation surrounding the bore section 26 while the second bore section 38 is drilled. FIG. 8 of the drawings illustrates the pressure differential along the length of the horizontal sections 26, 38 during the drilling of the respective sections. Without the requirement to cement the first bore section and then perforate and complete a cemented section, the extended horizontal section 16 may be drilled and be ready for production relatively quickly and inexpensively.

The skilled person will of course understand that the particular parameters and dimensions utilised in the illustrated example are merely provided by way of example.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason, the following claims should be studied to determine the true scope and content of this invention.

The invention claimed is:

1. A method of creating a horizontal wellbore section, the method comprising:

drilling a first horizontal bore section with a bore wall having a first bore diameter;

lining the first horizontal bore section with a first liner having a wall, the wall of the first liner comprising initially closed flow ports;

isolating the wall of the first bore section with the first liner, without the use of cement, to minimize the pressure differential during drilling the second horizontal bore section by isolating a first annulus between the wall of the first horizontal bore section and the first liner;

subsequently drilling a second horizontal bore section beyond the first horizontal bore section which includes the first liner therein, the second horizontal bore section having a bore wall with a second bore diameter;

lining the second horizontal bore section with a second liner;

directing stimulation fluid into the first and second liners so that the stimulation fluid passes through the wall of the second liner to stimulate the second horizontal bore section; and opening flow ports in the wall of the first liner so that the stimulation fluid passes through the wall of the first liner and through the first annulus to stimulate the first horizontal bore section.

2. The method of claim 1, wherein one or both of the first horizontal bore section and the second horizontal bore section are drilled until a predetermined differential pressure over a length of the bore section is reached.

3. The method of claim 2, wherein the predetermined differential pressure over the length of the bore section is 800 psi.

4. The method of claim 1, comprising initially closing the flow ports in the wall of the first liner with plugs that are at least partially soluble in the stimulation fluid.

5. The method of claim 1, wherein the stimulation fluid comprises an acid.

6. The method of claim 1, comprising flowing fluid from the formation and into the well through the flow ports.

7. The method of claim 1, wherein bore fluid is isolated within the first annulus.

8. The method of claim 1, comprising activating at least one barrier provided on the first liner to engage with the wall of the first bore section.

9. The method of claim 8, wherein the at least one barrier is provided at a distal end of the first liner.

10. The method of claim 9, wherein at least two barriers are provided towards the distal end of the first liner.

11. The method of claim 8, wherein the at least one barrier is provided towards a proximal end of the first liner.

12. The method of claim 1, wherein the first liner has a first liner diameter and the second bore diameter is smaller than the first liner diameter.

13. The method of claim 1, wherein the second liner is provided with flow ports.

14. The method of claim 13, wherein the flow ports in the second liner are open when the second liner is installed in the second horizontal bore section.

15. The method of claim 1, wherein at least one of the first liner and the second liner is a controlled acid jetting (CAJ) liner.

16. A wellbore-lining apparatus for lining a horizontal wellbore section comprising first and second bore sections, the apparatus comprising:

a first wellbore liner, comprising initially closed flow ports, having a wall and an isolation barrier towards a distal end of the wall, wherein the first wellbore liner extends through the first bore section and the isolation barrier is configurable to engage a wall of the first bore section, without the use of cement, to isolate the first bore section to minimize the pressure differential during drilling the second bore section by isolating a first annulus between the wall of the first horizontal bore section and the first liner; and a second wellbore liner for lining the second bore section beyond the first bore section.

17. The wellbore-lining apparatus of claim 16, wherein the first and second wellbore liners are configured to be installed in the wellbore separately.

18. The wellbore-lining apparatus of claim 17, wherein the first wellbore liner is configured to be installed in the first bore section and permit the second bore section to be drilled beyond the first bore section with the first wellbore liner installed therein.

19. The wellbore-lining apparatus of claim 17, wherein the second wellbore liner is configured to be installed through the first lined bore section and into the second bore section.

20. The wellbore-lining apparatus of claim 16, wherein the first wellbore liner has at least two isolation barriers towards the distal end of the wall.

21. The wellbore-lining apparatus of claim 16, wherein the first wellbore liner has at least one isolation barrier towards a proximal end of the wall.

22. The wellbore-lining apparatus of claim 16, wherein the flow ports are closed by plugs dissolvable by stimulation fluid.

23. The wellbore-lining apparatus of claim 16, wherein the second liner comprises flow ports.

24. The wellbore-lining apparatus of claim 23, wherein the flow ports in the second liner are initially open.

25. The wellbore-lining apparatus of claim 16, wherein the first liner has a first liner diameter and the second bore diameter is smaller than the first liner diameter.

26. The wellbore-lining apparatus of claim 16, wherein at least one of the first and second liners is a fixed diameter liner.

27. The wellbore-lining apparatus of claim 16, wherein at least one of the first liner and the second liner is a controlled acid jetting (CAJ) liner.

28. A wellbore-lining apparatus for lining a horizontal wellbore section comprising first and second bore sections, the apparatus comprising:

a first wellbore liner having a wall including initially-closed flow ports for isolating the wall of the first bore section, without the use of cement, to minimize the pressure differential during drilling of the second bore section, by isolating a first annulus between the wall of the first bore section and the first the flow ports being closed by plugs dissolvable by stimulation fluid; and a second wellbore liner for lining the second bore section beyond the first bore section, wherein, in use, stimulating fluid directed into the first and second wellbore liners passes through the second wellbore liner to stimulate the second horizontal bore section, and the stimulation fluid dissolves the plugs in the first wellbore liner to open the flow ports in the wall of the first wellbore liner so that the stimulation fluid passes through the wall of the first wellbore liner to stimulate the first horizontal bore section.

29. The wellbore-lining apparatus of claim 28, wherein at least one bore wall-engaging barrier is provided on the first liner.

30. The wellbore-lining apparatus of claim 29, wherein at least one bore wall-engaging barrier is provided at a distal end of the first liner.

31. The wellbore-lining apparatus of claim 30, wherein at least two bore wall-engaging barriers are provided towards the distal end of the first liner.

32. The wellbore-lining apparatus of claim 29, wherein at least one bore wall-engaging barrier is provided towards a proximal end of the first liner.

33. The wellbore-lining apparatus of claim 28, wherein the plugs are acid soluble.

34. The wellbore-lining apparatus of claim 28, wherein the second liner comprises flow ports.

35. The wellbore-lining apparatus of claim 34, wherein the flow ports in the second liner are initially open.

36. The wellbore-lining apparatus of claim 28, wherein the first liner has a first liner diameter and the second bore diameter is smaller than the first liner diameter.

37. The wellbore-lining apparatus of claim 28, wherein at least one of the first and second liners is a fixed diameter liner.

38. The wellbore-lining apparatus of claim 28, wherein at least one of the first liner and the second liner is a controlled acid jetting (CAJ) liner.

* * * * *